US007176929B1

(12) United States Patent
Morrish

(10) Patent No.: US 7,176,929 B1
(45) Date of Patent: Feb. 13, 2007

(54) LOW COST ANIMATED SEQUENCE FUNCTION FOR LOW COST OSD DEVICES

(75) Inventor: Andy Morrish, Saratoga, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 145 days.

(21) Appl. No.: 09/908,119

(22) Filed: Jul. 17, 2001

(51) Int. Cl.
*G09G 5/36* (2006.01)
*G09G 5/00* (2006.01)

(52) U.S. Cl. ..... 345/545; 345/581

(58) Field of Classification Search ..... 345/536, 345/537, 569, 589, 475, 545, 522
See application file for complete search history.

(56) References Cited

U.S. PATENT DOCUMENTS 5,870,074 A * 2/1999 Iwasaki ..... 345/467
5,969,727 A * 10/1999 Kaneko ..... 345/536
5,969,770 A * 10/1999 Horton ..... 348/569
5,990,860 A * 11/1999 Takeuchi ..... 345/667
6,057,813 A * 5/2000 Matsumoto ..... 345/26
6,072,462 A * 6/2000 Movshovich ..... 345/467
6,181,353 B1 * 1/2001 Kurisu ..... 345/537
6,195,078 B1 * 2/2001 Dinwiddie et al. ..... 345/636
6,208,354 B1 * 3/2001 Porter ..... 345/634
6,215,467 B1 * 4/2001 Suga et al. ..... 345/660
6,256,027 B1 * 7/2001 Jeong et al. ..... 345/788
6,262,710 B1 * 7/2001 Smith ..... 345/589
6,263,317 B1 * 7/2001 Sharp et al. ..... 705/26
6,351,291 B1 * 2/2002 Asano ..... 348/564
6,351,292 B1 * 2/2002 Knox et al. ..... 348/569
6,452,641 B1 * 9/2002 Chauvel et al. ..... 348/569
6,462,746 B1 * 10/2002 Min et al. ..... 345/545
6,466,215 B1 * 10/2002 Matsuda et al. ..... 345/475
6,542,162 B1 * 4/2003 Hrusecky et al. ..... 345/629
6,611,269 B1 * 8/2003 Uehara et al. ..... 345/522
6,664,970 B1 * 12/2003 Matsushita ..... 345/581

* cited by examiner

*Primary Examiner*—Kee M. Tung
*Assistant Examiner*—Jin-Cheng Wang
(74) *Attorney, Agent, or Firm*—Merchant & Gould P C

(57) ABSTRACT

The present invention provides a low cost animation sequence function for OSDs. An animation sequence is produced by changing the attributes associated with a character within the OSD rather than by substituting the character itself. A character may have several different attributes associated with it. These attributes change the colors associated with the pixels within the character producing a different character visually. The attributes are selected and changed according to a predetermined interval to produce the animation sequence. Each attribute is displayed for the predetermined time before moving on to displaying the character using the next attribute to produce the animation sequence. Each color attribute associated with the character in the animation sequence uses up only two words of ROM space, whereas the character itself takes up eight words or more of ROM space. Therefore, there is considerable savings in ROM space as compared to storing a separate character for each animation frame.

20 Claims, 14 Drawing Sheets

1100

LOW COST ANIMATED SEQUENCE FUNCTION FOR LOW COST OSD DEVICES

FIELD OF THE INVENTION

The present invention is related to electronics, and more specifically to an electronic circuit for producing an animated sequence for on screen displays.

BACKGROUND OF THE INVENTION

Many computers, televisions, and other equipment use on screen displays (OSDs) to display and adjust parameters related to the equipment. For example, OSDs may visually represent the level of volume, contrast, brightness, vertical position, horizontal position, and the like. While the user is adjusting the parameter, the OSD provides visual feedback to the user relating to the adjustment they are performing.

Additional visual feedback may be provided by some OSDs by displaying animation sequences. The animation sequences are intended to help show the user the effect of adjusting a particular parameter on the device. For example, an animation sequence may be used to show the user the effect of adjusting the contrast of a display. Performing these animations, however, can be very intensive for the OSD microcontroller.

Generally, the microcontrollers used within the OSD have difficulty performing the animation sequence. Not only does the microcontroller have to select, time, and display the characters used in the animation sequence, it also has to check the status of many parts of the screen. For example, the microcontroller may check whether a button has been pushed on the device. Each function the microcontroller performs adds more overhead and typically uses more memory stressing an already overloaded microcontroller. Because of all of these operations, most microcontrollers do not have enough power to handle all of these features plus perform the animation sequence.

In addition to storing all of the independent characters used for the animation sequences and the OSD, most OSDs are language dependent. Therefore, the microcontroller has to store and remember characters for all of the different supported languages. This takes up even more memory, space and power within the OSD system.

SUMMARY OF THE INVENTION

The present invention is directed at providing a low cost animation sequence function for OSDs.

According to one aspect of the invention, an animation sequence is produced by changing the attributes associated with a character rather than by changing the character itself to produce the animation effect.

According to another aspect of the invention, a character may have several different attributes. These attributes may alter the colors associated with the pixels contained within the character.

According to yet another aspect of the invention, the attributes are changed according to a predetermined interval to produce the animation sequence. Each attribute is applied to the character and displayed for the predetermined time before selecting another attribute to apply to the character. Selecting different attributes to apply to the character creates the appearance of the character changing.

According to still yet another aspect of invention, each color attribute associated with the character in the animation sequence uses up only two words of ROM space, whereas the character itself takes up eight words or more of ROM space. Therefore, there is savings in ROM space as compared to storing a separate character for each animation frame.

DETAILED DESCRIPTION OF THE PREFERRED EMBODIMENT

Figure 1:
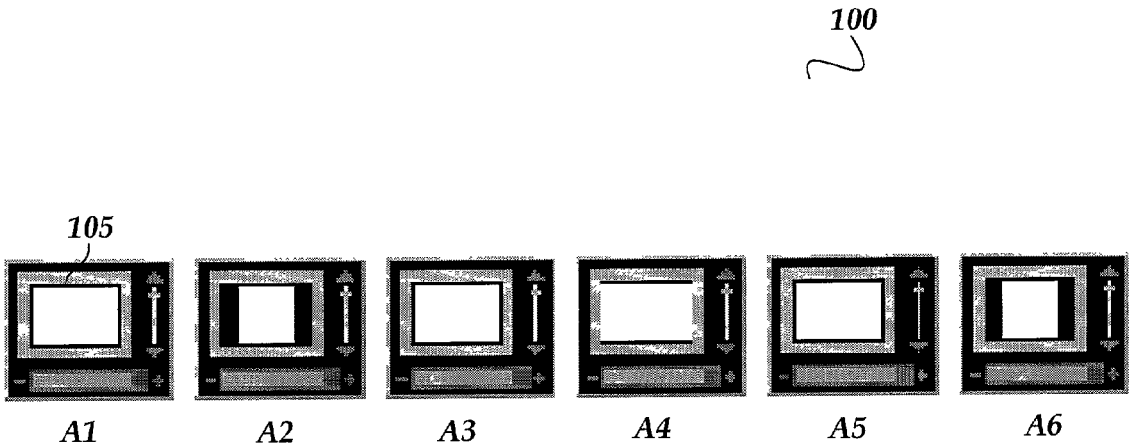
FIG. 1 illustrates an exemplary animation sequence.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The term "connected" means a direct electrical connection between the items connected, without any intermediate devices. The term "coupled" means a direct electrical connection either between the items connected, or an indirect connection through one or more passive or active intermediary devices. The term "circuit" means either a single component or a multiplicity of components, either active and/or passive, that are coupled to provide a desired function. The term "signal" means at least one current, voltage, or data signal. Referring to the drawings, like numbers indicate like parts throughout the views.

Briefly described, the present invention is directed at providing a low cost animation system for an OSD. The animation is produced by alternating between a set of character attributes for a character to produce the animation sequence.

FIG. 1 illustrates an exemplary animation sequence, according to one embodiment of the invention. As shown in the figure, animation sequence 100 includes animation frames A1–A5 that may be cycled through to create an animation effect.

In devices utilizing on screen displays (OSDs) it is useful to display simple animations in order to help improve the depth of information presented to the user. According to one embodiment of the present invention, a function is provided whereby the device's OSD may display an animated screen character to show the effects of an adjustment the user is making.

According to this particular example, the user is graphically shown a monitor screen, with a character that changes attributes thereby providing the user with the effect of an animation. For example, a width adjustment window 105 shows a sequence of images on the displayed OSD monitor screen cycling through a sequence. In sequence A1 window adjustment window 105 appears to be normal size. Sequence A2 shows the window having a narrow size. Sequence A3 shows the window at normal size. Sequence A4 shows the window at a wide setting. Sequence A5 shows the window at normal setting, and sequence A6 shows the window at a narrow setting. Each frame is displayed for a predetermined time in order to create the animation effect. The functionality to perform the animation sequence is described below.

Figure 2:
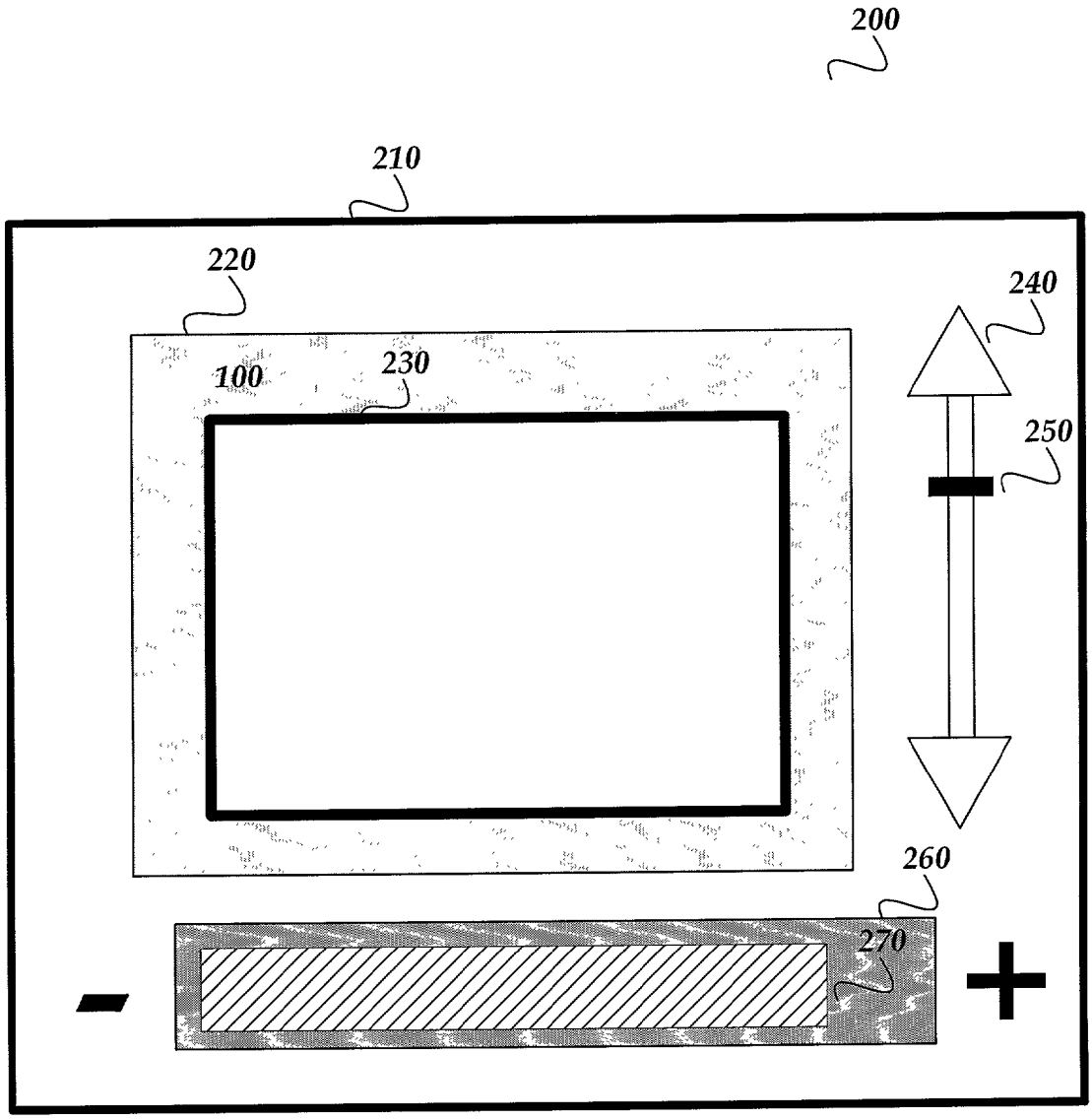
FIG. 2 shows an exemplary diagram of an OSD frame.

FIG. 2 shows an exemplary diagram of an OSD frame, according to one embodiment of the invention. As shown in the figure, OSD frame 200 includes frame 210, screen frame 220, programmable area 230, vertical bar 240, vertical indicator 250, horizontal bar frame 260, and horizontal bar indicator 270.

Frame 210 encloses screen frame 220, programmable screen 230, vertical bar 240, vertical indicator 250, horizontal bar frame 260, and horizontal bar indicator 270. Screen frame 220 encloses programmable area 230. Vertical indicator 250 is positioned along vertical bar 240, and horizontal bar indicator 270 is located and sized to be within horizontal bar frame 260.

According to one embodiment of the invention, OSD frame 200 is a 6×5 character matrix, is preprogrammed within the device, and is static. The OSD frame may be turned on or off by an external command from the microcontroller. Each of the characters within the OSD is an 8×8 pixel cell and may use up to four colors. For example, according to one embodiment, within a simple OSD device, OSD frame 200 appears as shown in the figure. As OSD frame 200 is preprogrammed, the microcontroller stores and sends only minimal information at power up regarding the size and position of simple OSD frame 200 on the displayed screen, and is thereafter simply turned on or off by writing to one register. According to another embodiment, the OSD frame may be dynamic and change based on the parameter being adjusted.

The simple OSD frame shows the user basic views of the functions that are the subject of the interface. According to the present example, which is designed for computer display applications, OSD frame 200 gives the user the appearance of a computer screen. As will be appreciated, many other OSD frames may be designed. For example, the OSD frame may give the appearance of a phone, a television, or any other device consistent with the application. Within screen frame 220 is programmable area 230. Programmable area 230 allows substitution of up to six different characters and may be used to display an animation sequence. Other sizes may be chosen for programmable area 230. According to one embodiment, up to sixteen different animation sequences may be selected (See FIGS. 10 and 11 for representative animation sequences) to provide the user with information about the selected OSD function. In this way, the same basic information that may be presented through a conventional non-OSD approach, where the same basic icons may have either been printed or embossed on the bezel of the device, may be shown in the OSD. The icons may be chosen in many different ways. For example, a bit code may be sent to the OSD that maps the appropriate icons into programmable area 230 without external intervention by the microcontroller.

As will be appreciated in view of the present disclosure, the size, shape, and color of the frame and the icon space may be different between applications, but the same general concept may be applied as in the present example, which is described herein only as an illustration of the invention.

Figure 3:
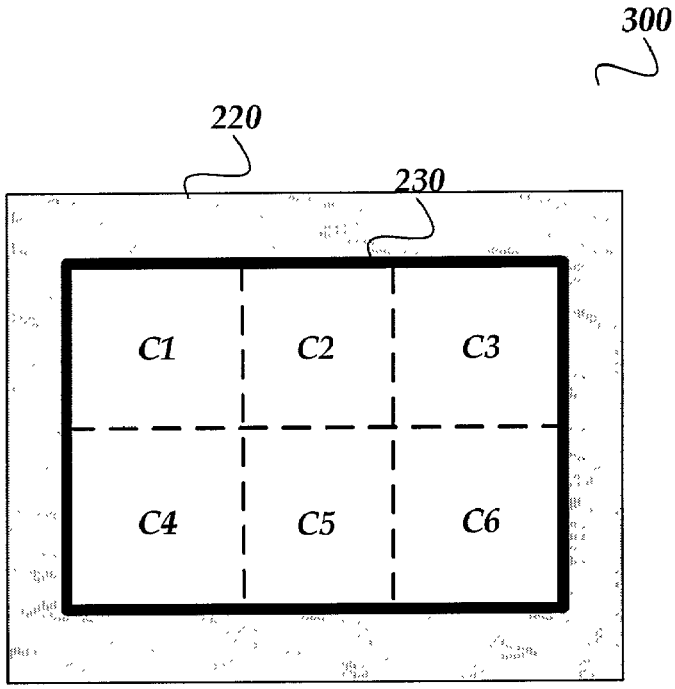
FIG. 3 illustrates a schematic diagram of a programmable area for an OSD.

FIG. 3 illustrates a programmable area within an OSD frame, according to an embodiment of the invention. As shown in the figure, frame 220 contains programmable area 230 that includes six character locations (C1–C6).

Within programmable area 230, six characters may be placed at locations C1–C6, allowing different characters to be formed representing the adjustment being carried out. For example, characters C1–C6 may be chosen to create one of the animation sequences illustrated in FIG. 10 or 11.

Each character within programmable area can display up to four colors. These four colors are independent of the colors chosen for another character within programmable area 230. As will be appreciated, more or less colors may be displayed within a single character depending on the specific hardware used. According to one embodiment of the invention, characters C1–C6 remain static to produce the animation effect but the color attributes applied to the character change to give the appearance that the character is changing. The characters making up the frame of the OSD, as discussed above, are static, according to one embodiment of the invention.

Figure 4:
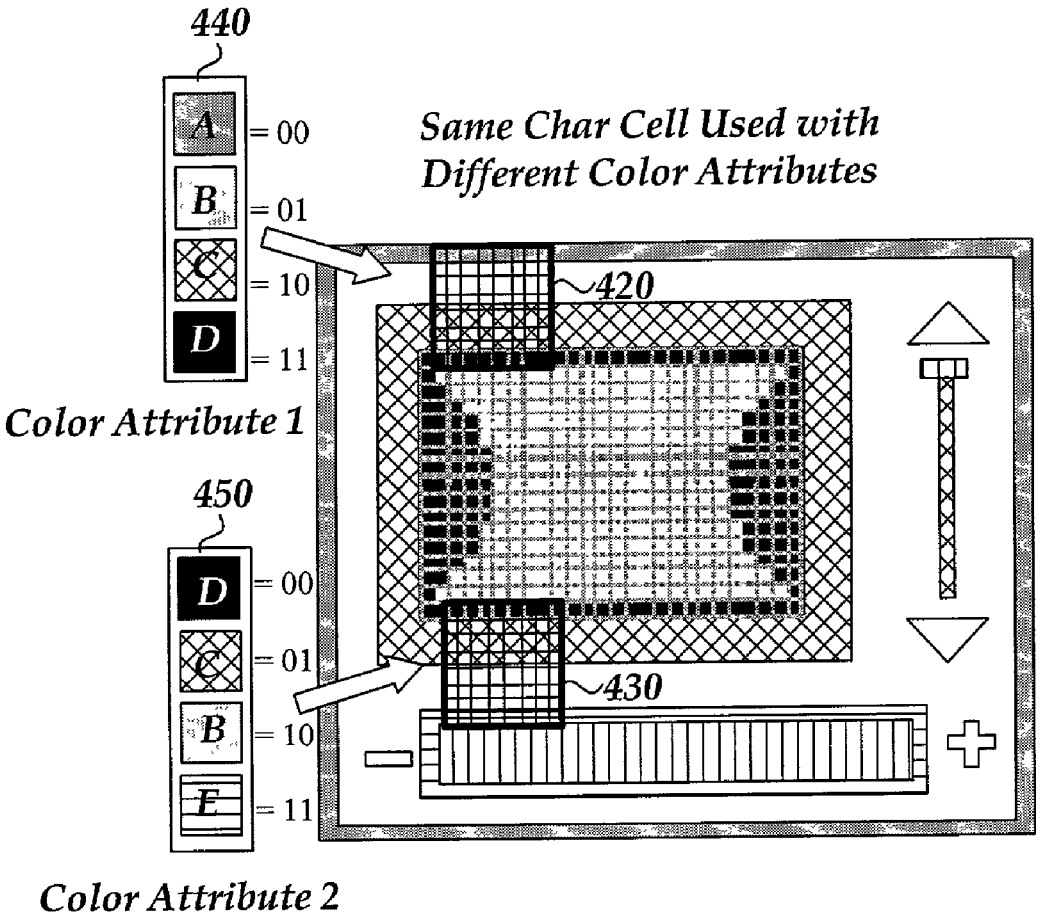
FIG. 4 shows exemplary color attributes for two character cells.

FIG. 4 shows exemplary color attributes for two character cells, according to one embodiment of the invention. As shown, the figure includes 8×8 character cell 420, 8×8 character cell 430, color attribute 440, and color attribute 450.

In order to achieve the animation effect in an economic fashion utilizing a low cost microcontroller, advantage is taken of the fact that, according to one embodiment of the invention, the OSD system allows each pixel within the displayed characters to be defined as one of four colors. A separate attribute code pointing to an attribute table allows for the definition of each color on a character-by-character basis (See FIG. 8 and related discussion).

As can be seen by referring to the figure, character cell 420 and character cell 430 includes 64 pixels arranged in 8×8 grid. Within any character four colors may be displayed. That is, each pixel of character cell 420 or character cell 430 may be displayed as one of the four colors shown in color attribute 440 or color attribute 450, or some other attribute table not shown. Color attribute 440 includes colors A, B, C, and D. Each color is assigned a color code that is a two-bit definition for the color. For example, color A has a color code 00, color B has a color code 01, color C has a color code 10 and color D has a color code 11. The colors may be any colors available within the system. For example, colors A, B, C, and D may correspond to gray, blue, brown, and black, or they may correspond to red, orange, white, and cream. Character cell 430 includes the four colors shown in color attribute table 450. Color attribute table 450 includes colors B, C, D, and E. Color E may correspond to any color. For example, color E may be green. While color attribute tables 440 and 450 are shown to have only one color difference, the invention is not so limited. Each color attribute may have four colors independent of the other characters.

Figure 5:
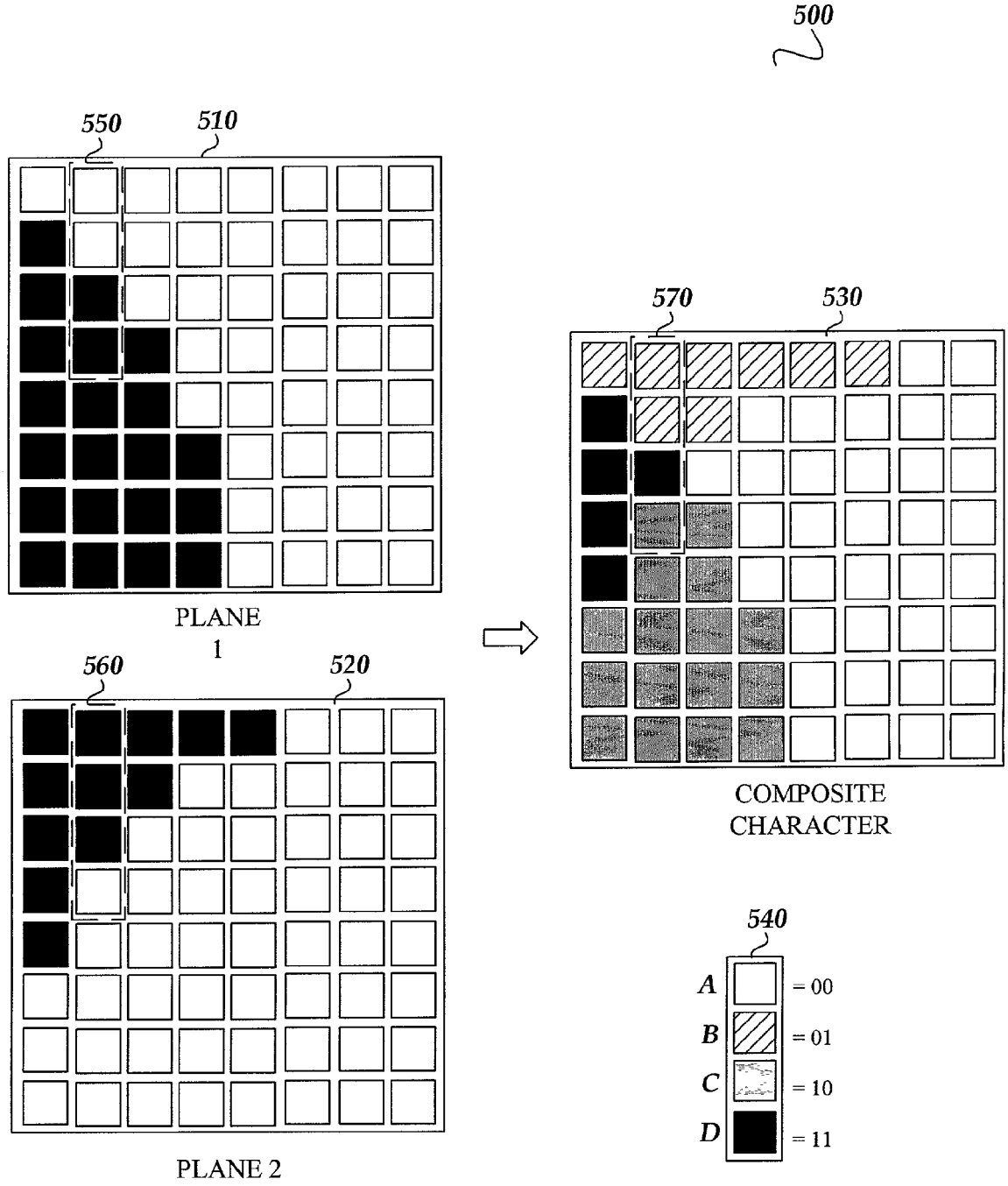
FIG. 5 illustrates a two plane coloring system to produce a composite character.

FIG. 5 illustrates a two plane coloring system to produce a composite character according to one embodiment of invention. As shown in the figure, two plane coloring system 500 includes character 510 in the first plane, character 520 in the second plane, composite character 530 and color attribute 540.

Each character plane includes two different colors and the colors may be defined by a single bit. For example, a bit value of one may indicate a black pixel, and a bit value of zero may indicate a white pixel for one character frame. According to the present example, character 510 includes a portion of the character filled with one color and the remaining portion filled with another color. Similarly, character 520 includes two separate colors.

The coloring for composite character 530 will now be described. Composite character 530 is created by combining character 510 and character 520 according to an attribute table. Each bit location within each plane is analyzed to determine the resulting color of the bit in the composite character. For exemplary purposes, the composition of first plane bits 550 contained within character 510 with second plane bits 560 contained within character 520 are colored according to color attribute 540. From top to bottom within the figure, first plane bits 550 include pixels that are white, white, black and black and represent pixel codes 0, 0, 1, and 1, respectively. Second plane bits 560 include pixels that are black, black, black, and white and represent pixel codes 1, 1, 1, and 0, respectively. The composition of first plane bits 550 with second plane bits 560 produces pixel codes 01, 01, 11, and 10, respectively. Mapping these pixel codes to color attribute table 540 results in the pixel codes being assigned colors B, B, D, and C, respectively. A different color attribute table could map the composite pixels to different colors. Similarly, composite character 530 may be displayed as character 510 or character 520 by applying a different attribute table to character 530.

Figures 6A, 6B, 6C:
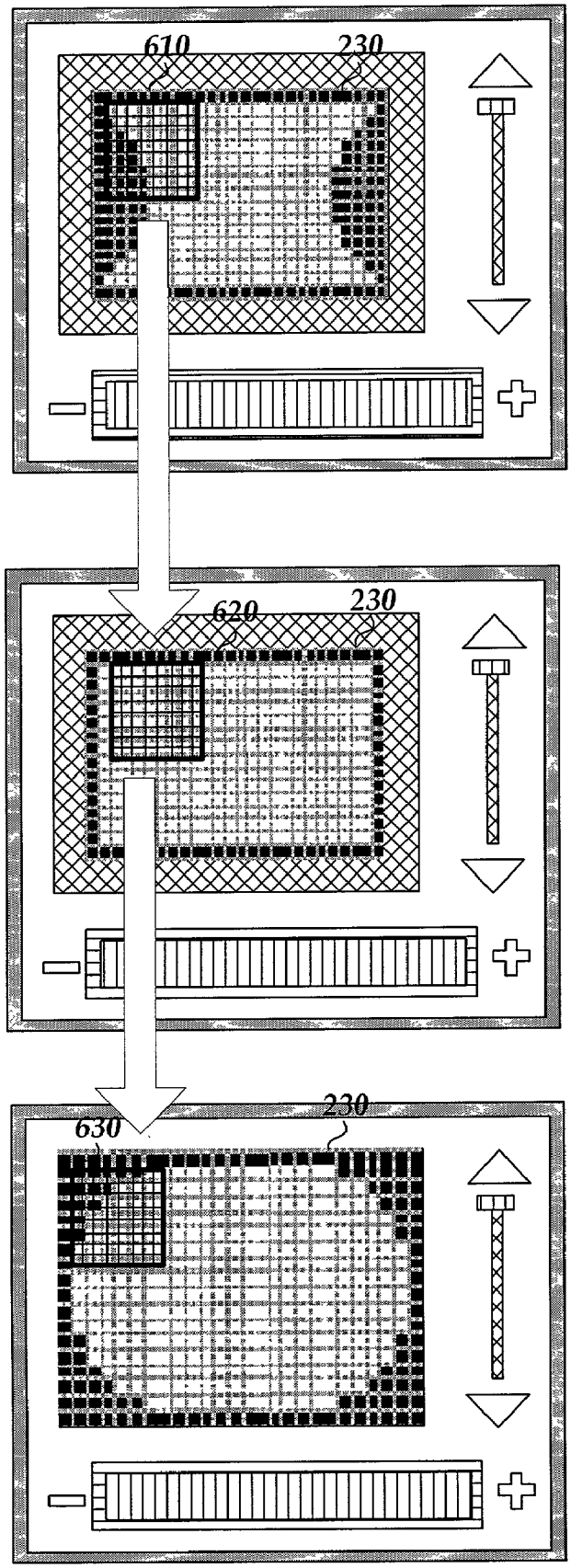
FIGS. 6A–6C show how the colors within a character cell are switched by selecting a different attribute to create alternating images to create an animation effect.

FIGS. 6A–6C show how the colors within a character cell are switched by selecting a different attribute to create alternating images to create an animation effect, according to one embodiment of the invention. FIG. 6A illustrates a first frame of an animation sequence. FIG. 6B shows a second frame of an animation sequence, and FIG. 6C illustrates a third frame of an animation sequence.

FIGS. 6A–6C include characters 610, 620, and 630, respectively. Characters 610, 620 and 630 are the same character but are displayed using different colors according to an attribute table. In order to provide the animation effect, the portion of the OSD that is to be animated typically uses two colors. More colors may be displayed depending on the number of color planes used within the OSD as well as the animation effect desired. According to this particular example, programmable area 230 of the display icon is defined as white and black. It will be appreciated that the colors chosen may be other colors. The two plane composite character contains the information from both planes, but by switching between appropriate color codes chosen from a color attribute table, each plane can be selected separately to display what appears to be a different character.

As can be seen by referring to FIGS. 6A–6C the character illustrated in characters 610, 620 and 630 appears to change during the animation sequence even though the character itself does not change. Instead, the colors within the character change and not the character itself.

Figure 7A:
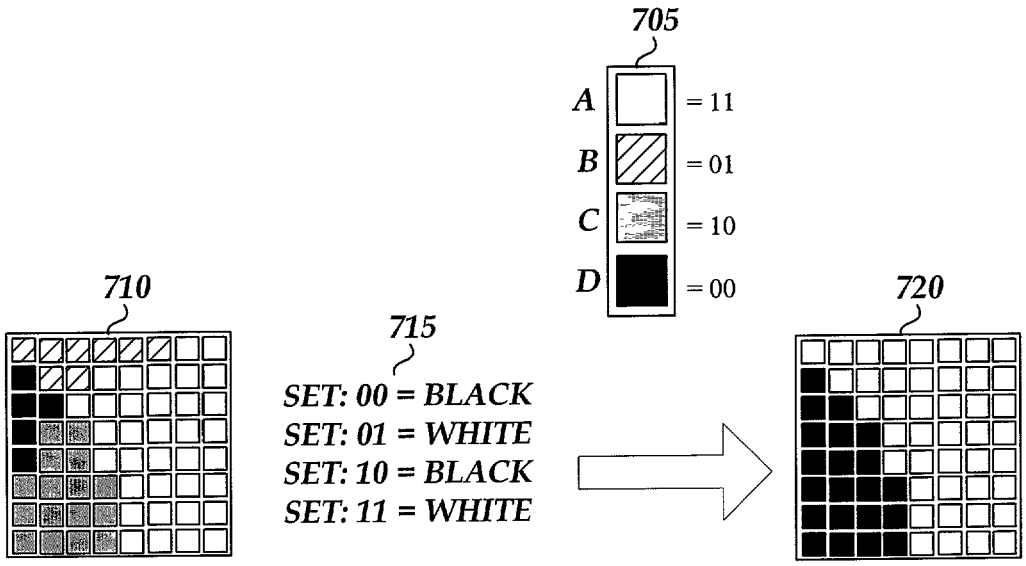
FIGS. 7A–7C illustrate assigning different attributes to a character to produce the animation effect as shown in FIGS. 6A–6C.
Figure 7B:
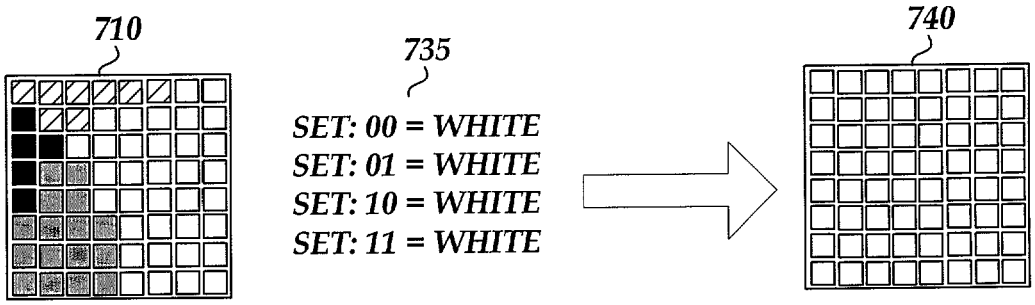
Figure 7C:
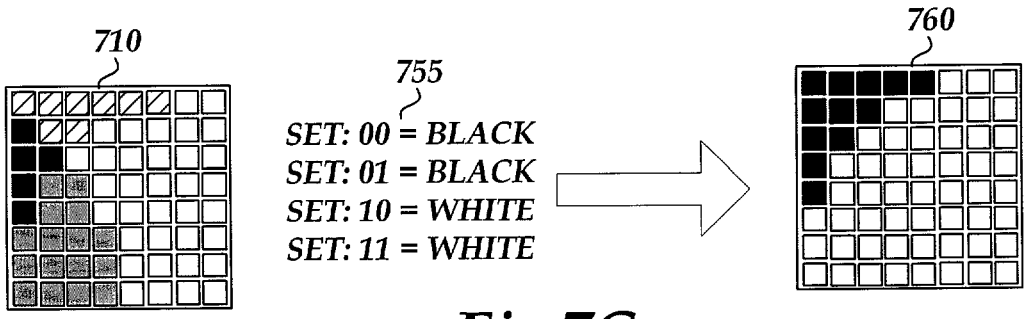

FIGS. 7A–7C illustrate assigning different color attributes to an exemplary character to produce the animation effect as shown in FIGS. 6A–6B, according to one embodiment of the invention. Character 710 is the same character displayed in each of FIGS. 7A–7C, has the same composite colors, and represents characters 610, 620 and 630, respectively. Character 710 appears to change according to each animation frame, but the selection of colors for the different planes creates the appearance of a different character on the display. Character 710 includes four colors A, B, C, and D as illustrated by color attribute 705. Colors A, B, C, and D have pixel codes 11, 01, 10, and 00, respectively.

FIG. 7A illustrates applying a first color attribute to a character, according to one embodiment of the invention. As shown, FIG. 7A includes character 710, color attribute 715, and animation character 720.

Color attribute 715 sets pixel codes 00 and 10 to black, and pixel codes 01 and 11 to white. Applying color attribute table 715 to character 710 results in animation character 720. Animation character 720 includes two colors. Generally, to produce animation character 720, 740, and 760, color selection logic (described below) receives the pixel code for each character and applies an associated color attribute table to the character. It will be appreciated in view of the present disclosure that the colors used in character 710 or animation characters 720, 740, and 760 may be different from the illustrated colors.

FIG. 7B illustrates applying a second color attribute table to a character, according to one embodiment of the invention. As shown, FIG. 7B includes character 710, color attribute table 735, and animation character 740.

Color attribute 735 sets all of the pixel codes to white. Applying color attribute 735 to character 710 results in animation character 740. As can be seen, animation character 740 is completely white.

FIG. 7C illustrates applying a third color attribute table to a character, according to one embodiment of the invention. As shown, FIG. 7C includes character 710, color attribute table 755, and animation character 760.

Color attribute 755 sets pixel codes 00 and 01 to black, and pixel codes 10 and 11 to white. Applying color attribute table 755 to character 710 results in animation character 760 that is different from animation character 720 or animation character 740. Animation character 760 includes two colors.

Referring to FIGS. 7A–7C it can be seen that a completely different looking character may be displayed by applying different color attributes to the same character producing different animation effects.

Figure 8:
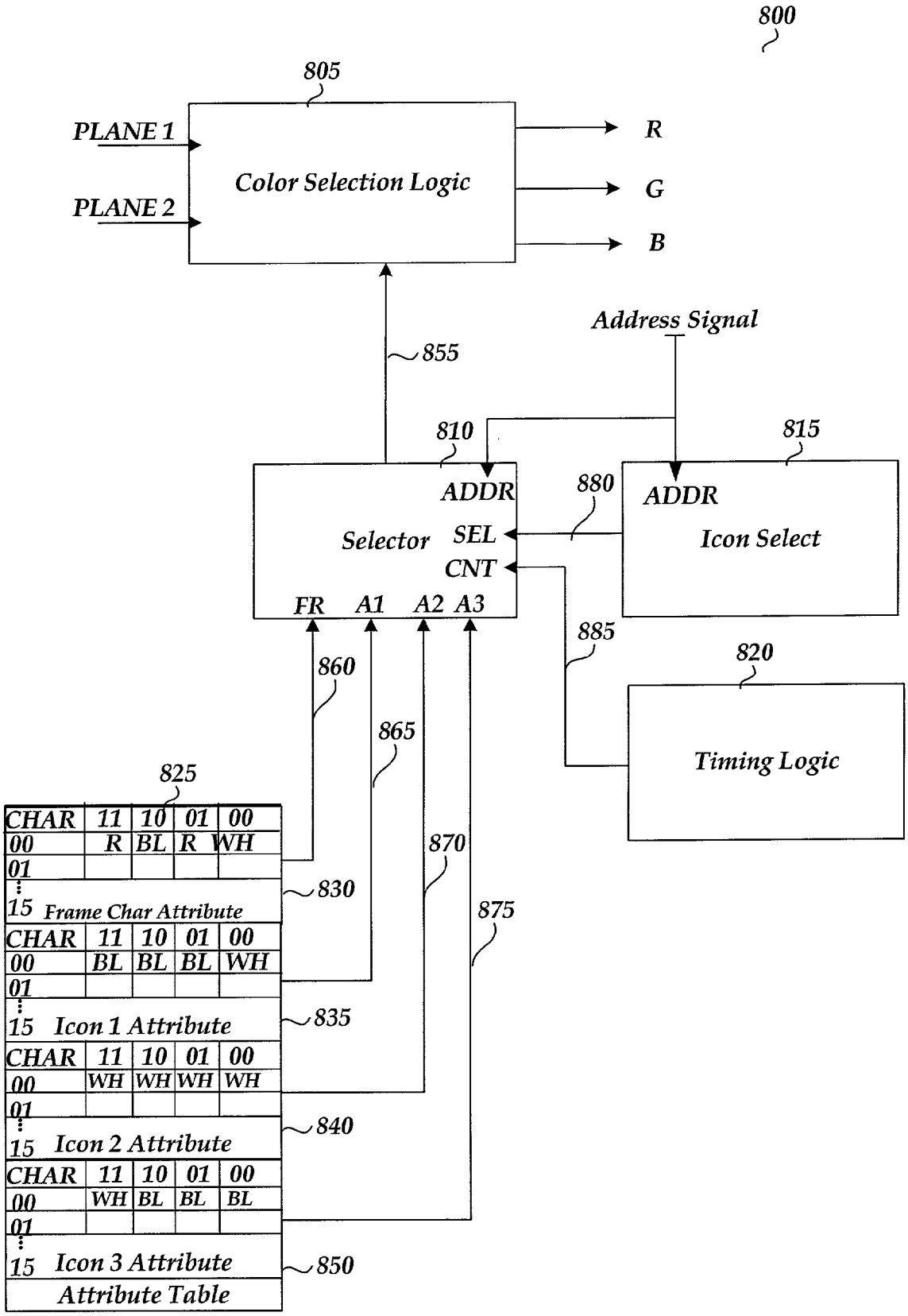
FIG. 8 shows an overview schematic diagram of an OSD animation system.

FIG. 8 illustrates an overview schematic diagram of an OSD animation system in accordance with the invention. As shown in the figure, OSD animation system 800 includes color selection logic 805, selector 810, icon select 815, timing logic 820, and attribute table 825. Attribute table 825 includes frame character attribute 830, icon 1 attribute 835, icon 2 attribute 840, and icon 3 attribute 850.

Color selection logic 805 has an input coupled to node 855, a plane 1 input, a plane 2 input, and three video outputs for red (R), green (G), and blue (B) video signals. Selector 810 has an ADDR input coupled to an address signal an FR input coupled to node 860, an A1 input coupled to node 865, an A2 input coupled to node 870, an A3 input coupled to node 875, a SEL input coupled to node 880, a CNT input coupled to node 885, and an output coupled to node 855. Frame character attribute 830 has an output coupled to node 860. Icon 1 attribute 835 has an output coupled to node 865. Icon 2 attribute 840 has an output coupled to node 870. Icon 3 attribute 850 has an output coupled to node 875. Icon select 815 has an ADDR input coupled to an address signal and an output coupled to node 880, and timing logic 820 has an output coupled to node 885. Frame character attribute 830, icon 1 attribute 835, icon 2 attribute 840, and icon 3 attribute 850 each include pixel code information for sixteen different characters. The pixel code information may represent up to four colors within each character.

The operation of OSD animation system will now be described. During drawing of the frame for the OSD display, selector 810 selects the FR input and outputs a signal at node 855 having the frame character attributes associated with the character that is being drawn. According to one embodiment of the invention, Selector 810 is arranged to determine the current drawing location within the OSD frame in response to the address signal. Color selection logic 805 receives the frame attributes and draws the frame characters making up the OSD frame. When the OSD display is drawing a character within the programmable area of the OSD frame, as described above, icon select 815 produces an icon enable signal at node 880 indicating that an animation sequence may be displayed. Icon select 815 is arranged to determine when the drawing location is within the programmable area of the OSD frame in response to the address signal. Selector 810, in response to the icon enable signal received at the SEL input, begins the animation sequence. More specifically, selector 810 selects the attributes from icon 1 attribute 835, icon 2 attribute 840 and/or icon 3 attribute 850 depending on the sequencing instructions for the particular animation sequence. For example, the attributes may be selected by first choosing icon 1 attribute 835 then choosing icon 2 attribute 840, and then finally choosing icon 3 attribute 850. The attributes may be selected in any order, or a subset of the attributes may be selected. For example, icon 1 attribute 835 may be selected and then icon 3 attribute 850 may be selected. According to one embodiment of the invention, four separate color attribute banks are provided. Three of the attribute banks (icon 1 attribute 835, icon 2 attribute 840 and icon 3 attribute 850) provide the animation effect when applied to the character being displayed. The three attribute banks that provide the animation effect are alternatively switched in order to switch between color selections.

During the time icon select 815 produces the icon enable signal at node 880, selector 810 selects one of the attribute banks within attribute table 825 to provide the animation effect. The selected attribute bank is applied to the character for a predetermined time.

Timing logic 820 counts to a predetermined value during the animation sequence. According to one embodiment of the invention, the predetermined time is counted in vertical field periods and is selected to provide an effective animation effect. The color attributes in attribute table 850 is cyclically accessed after a programmable number of vertical frames. Selector 810 receives the count information from timing logic 820 and moves selection from A1 to A2 to A3 during the animation sequence. Selection may be among all three animation character attributes (A1, A2, and A3), a single attribute, or two of the three attributes. Typically, inputs A1, A2, and A3 are selected for the same predetermined period. This selection repeats during the animation sequence.

Logic (not shown) generates a pixel stream for two planes. One pixel stream is received by the plane 1 input of color selection logic 805 and the other pixel stream is received by the plane 2 input of color selection logic 805. The pixel streams are generally a sequence of ones and zeroes representing whether a pixel is on or off. Color selection logic 805 expands the pixel streams to colors based on the selected attribute table selected by selector 810. Selector 810 knows what specific character is being displayed at a particular time and accesses the corresponding attribute for the character from the attribute table. Attribute table 825 is a look up table that defines the colors for a particular character being displayed by color selection logic 805. The color attribute information within attribute table 825 is fed to color selection logic 805 by producing a signal at node 855 representing the selected attributes. According to one embodiment of the invention, there are four banks of color attribute data. Frame character attribute 830 represents the first bank of attribute data and is used to specify the color combinations used by the frame characters of the OSD. Icon 1 attribute 835 is the second bank of attribute data and is used to represent the first animation frame. Icon 2 attribute 840 is the second bank of attribute data and is used to represent the second animation frame. Icon 3 attribute 850 is the third bank of attribute data and is used to represent the third animation frame. It will be appreciated in view of the present disclosure that the attribute banks may be stored in any order.

Color selection logic 805 selects the appropriate signal levels for the Red (R), Green (G) and Blue (B) output video signals for each of the four (4) input pixel code combinations. For example, a pixel code of 00 may be used to select an output color of black, a pixel code of 01 may be used to select an output color of blue, a pixel code of 10 may be used to select an output color of red and a pixel code of 11 may be used to select an output color of green. The particular color attributes to each pixel code can be altered by the color selection input 855. The selector 810 determines which color attributes to assign to the pixel based on inputs provided at nodes 880 and 885 from the icon select 815 and the timing logic 820 respectively. These inputs determine which color coding assignments to use from the four possible attribute sets stored in the attribute table 825. By switching between these attributes in a predetermined sequence, the appearance of the character will change, thus giving the desired effect of animation.

As will be appreciated in view of the present disclosure, the number of colors could expand to more planes to have more colors, but there is a tradeoff between space and usability. One of the compromises is the available resources of the hardware.

Figure 9:
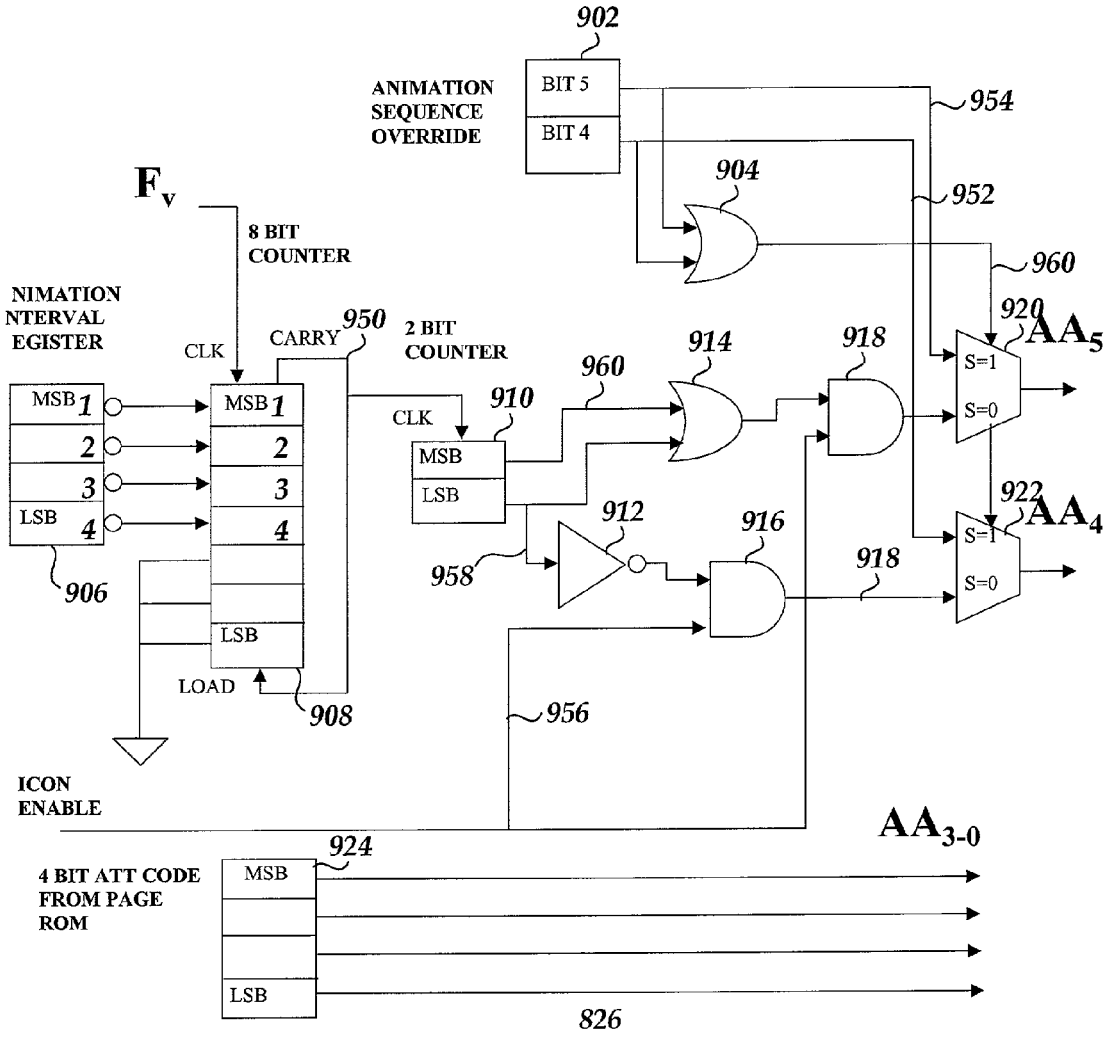
FIG. 9 shows a schematic diagram of an OSD animation system.

FIG. 9 illustrates a schematic diagram of an OSD animation system, according to one embodiment of the invention. As shown in the figure, OSD animation system includes animation sequence override register 902, OR gates 904 and 914, AND gates 916 and 918, NOT gate 912, selectors 920 and 922, 2-bit counter 910, 8-bit counter 908, animation interval register 906, and 4-bit attribute code 924.

OR gate 904 has an input coupled to node 954 and an input coupled to node 952, and an output coupled to node 960. Selector 920 has an input coupled to node 954, an input coupled to node 962, an input coupled to node 960, and an output AA5. Selector 922 has an input coupled to node 952, an input coupled to node 964, an input coupled to node 960, and an output AA4. Node 954 is coupled to bit 5 from register 902. Node 952 is coupled to bit 4 of register 902. AND gate 918 has an input coupled node 956, an input coupled to the output of OR gate 914, and an output coupled to node 962. AND gate 916 has an input coupled to the output of NOT gate 912, an input coupled to node 956, and an output coupled to node 964. OR gate 914 has an input coupled to the LSB of 2-bit counter 910, an input coupled to the MSB of 2-bit counter 910, and an output coupled to an input of AND gate 918. NOT gate 912 has an input coupled to the LSB of 2-bit counter 910, and an output coupled to an input of AND gate 916. 2 bit counter has an input coupled to node 950. 8-bit counter 908 has an input coupled to a signal Fv, a load input coupled to node 950, a carry output coupled to node 950, and bit inputs 1–4 coupled to bits 1–4 from alternate interval register 906. Node 956 is coupled to an icon enable signal.

The 4-bit value stored in animation interval register 906 sets the duration to use each color attribute table for a character before selecting the next color attribute table. The duration is timed in vertical fields according to one embodiment of the invention. 8-bit counter 908 is periodically loaded with the inverse of the duration value stored within animation interval register 906. After being loaded, 8-bit counter 908 counts up until an overflow condition occurs when the duration has been exceeded. When the overflow condition occurs, a carry/load signal is produced at node 950 that instructs counter 908 to reload the duration value and repeat the cycle. The carry/load signal is also received by 2-bit counter 910. In response to the carry/load signal, the two bit output from counter 910 is sent to NOT gate 912, and OR gate 914. An AND operation is performed on the icon enable signal and the output of OR gate 914 and another AND operation is performed on the output of NOT gate 912 and the icon enable signal to create the Attribute table address bits $AA_5$ and $AA_4$. The lower significant address bits ($AA_{3-0}$) come directly from the 4 bit attribute code in page Rom 924.

The animation sequence may be stopped on any displayed character. Animation sequence override register 902 allows the animation system to be stopped on any one of the attribute tables that in turn overrides the automatic selection of the attribute tables. According to one embodiment, a value of 00 within animation sequence override register means to perform the animation sequence, a value of 01 means to stop on the first attribute table, a value of 10 means to stop on the second attribute table, and a value of 11 means to stop on the third attribute table.

Figure 10:
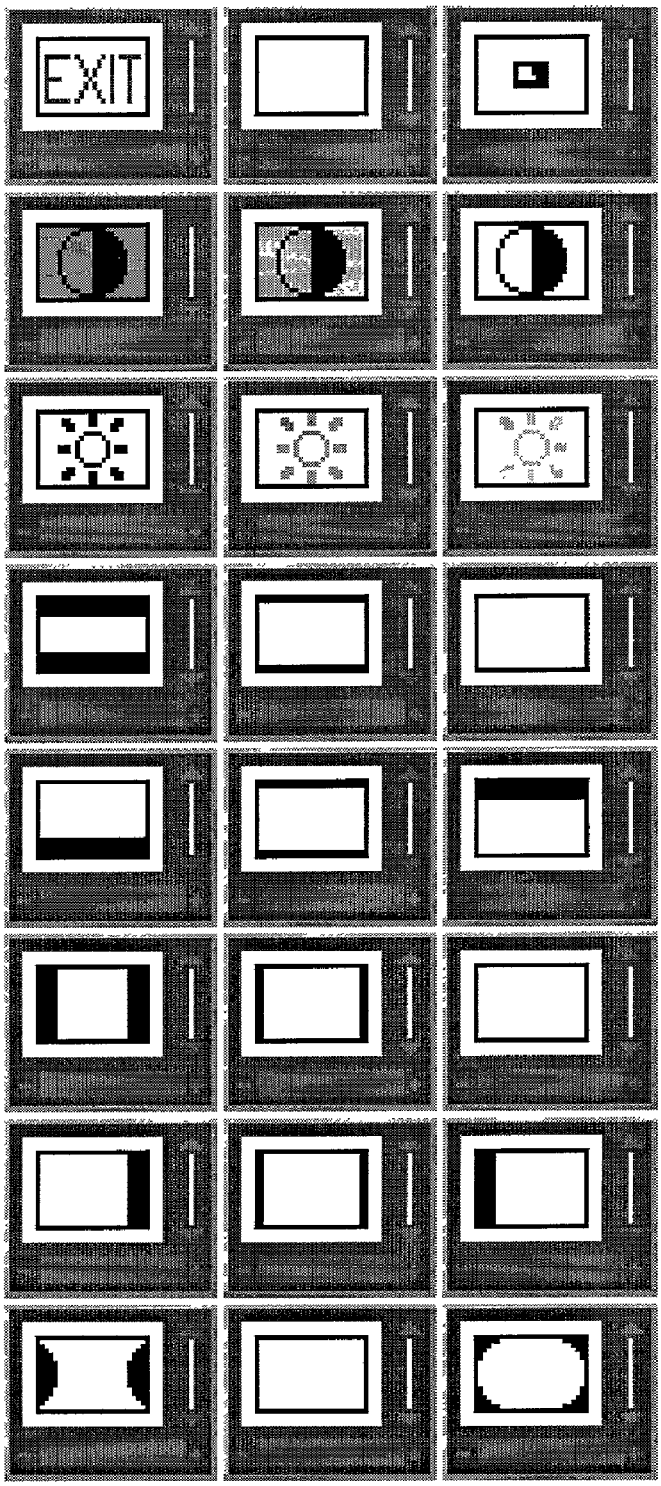
FIGS. 10 and 11 illustrate exemplary animation sequences.
Figure 11:
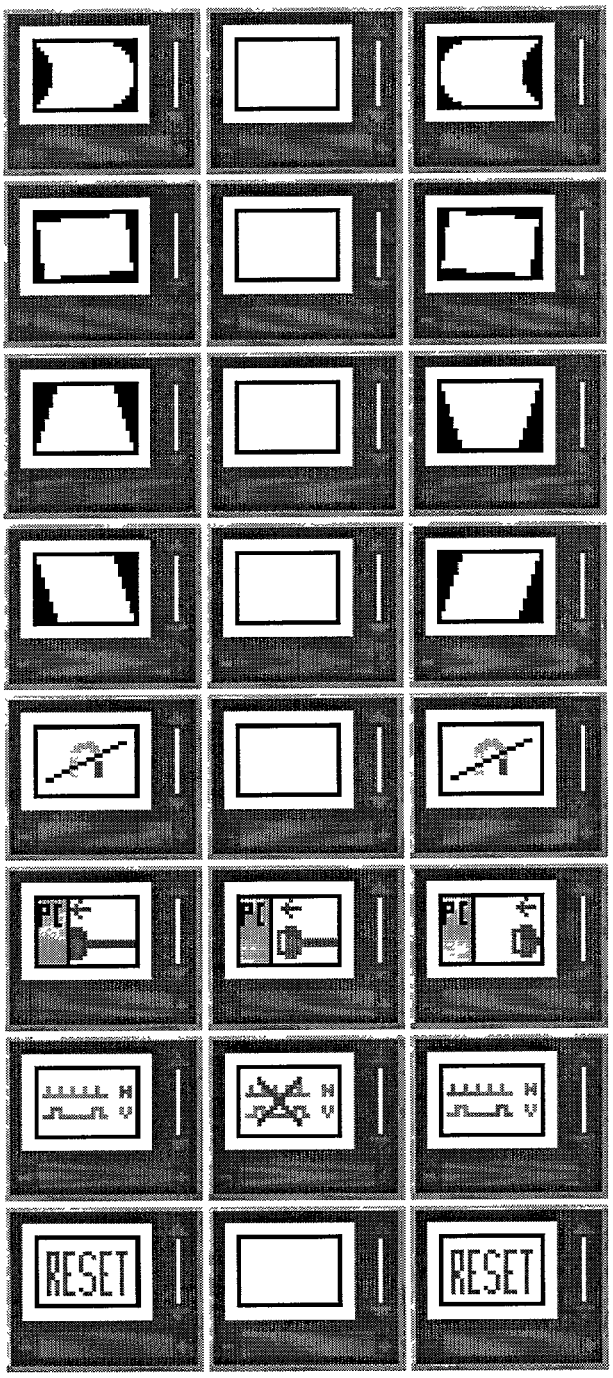

FIGS. 10 and 11 show exemplary animation sequence bitmaps, according to one embodiment of the invention. There are eight animation sequences shown in each figure. Each animation sequence has three separate attributes that may be applied to a character to create the animation effect. According to one embodiment of the invention, these are the initial icon bitmaps used for the animation sequences within the OSD system. As will be appreciated, other icon bitmaps may be used for the animation sequences depending upon the application.

Figure 12:
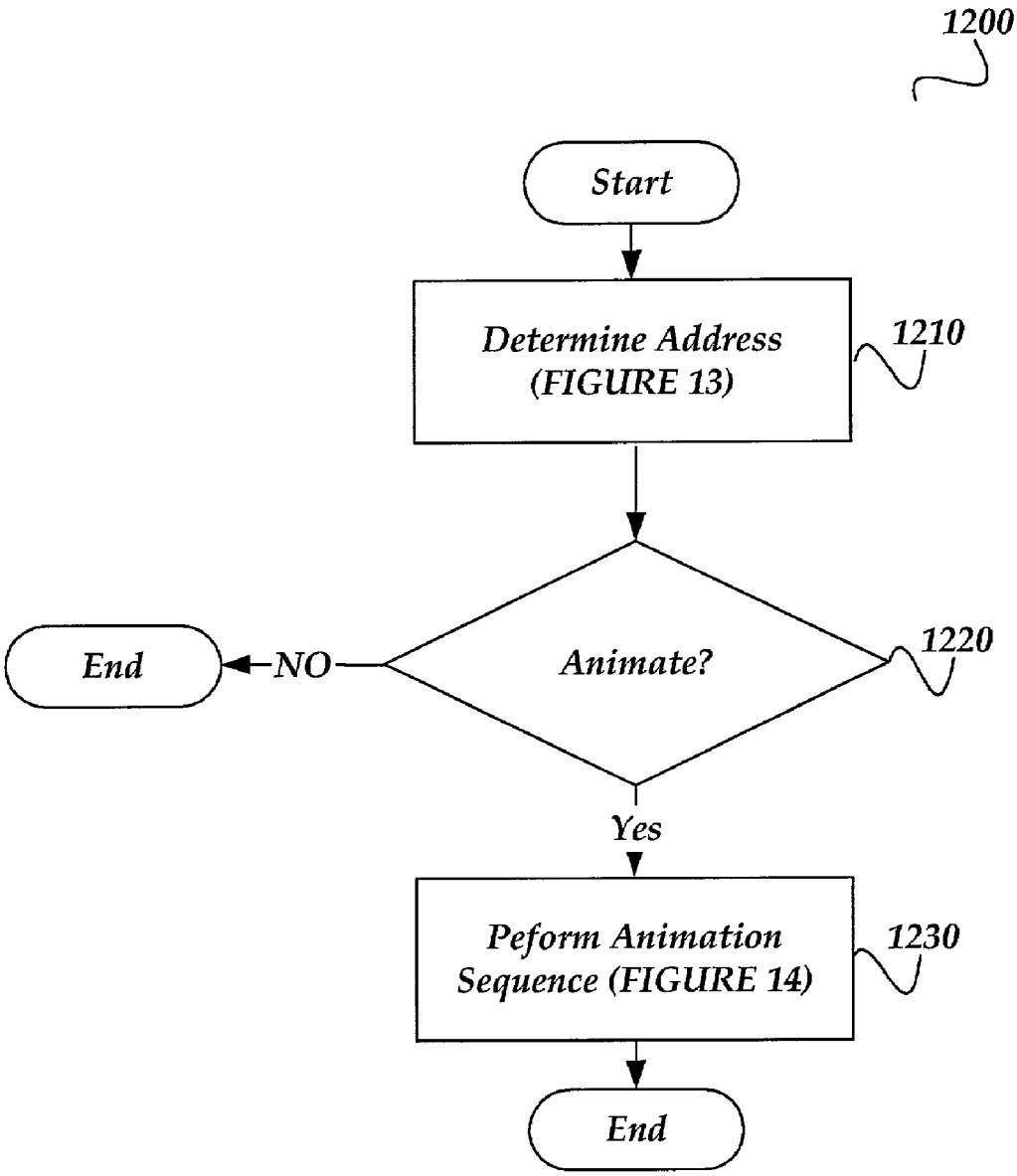
FIG. 12 illustrates an overview logical flow for operation of an OSD animation system.

FIG. 12 shows a logical flow for an OSD animation sequence system according to one embodiment of the invention. After a start block, the logical flow moves to a block 1210 at which point the current drawing address for the OSD system is determined (See FIG. 13 and related discussion). The determined address indicates the position that is currently being drawn by the OSD system, and whether or not the address is within the programmable area used for the animation sequence. When the address is within the programmable area used for the animation sequence, the logic moves to a decision block 1220 that determines whether an animation sequence is to be displayed. When there is not an animation sequence to be displayed, the logic moves to an end block and terminates. When there is an animation sequence to be displayed, the logic flows to a block 1230 at which point the animation sequence is performed. Generally, a set of differing color attributes are chosen for a character in sequence to produce an animation effect (See FIG. 13 and related discussion). The logical flow then moves to an end block and terminates.

Figure 13:
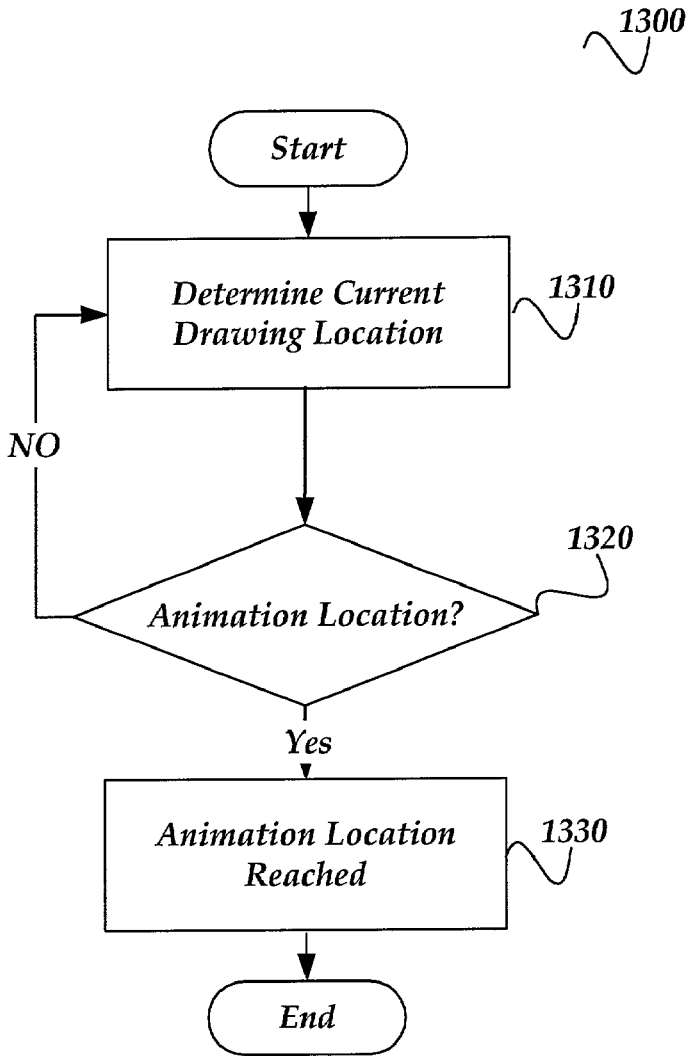
FIG. 13 illustrates a logical flow for locating a position to draw an animation sequence within an OSD frame.

FIG. 13 illustrates a logical flow for determining the drawing location within the OSD animation system, according to one embodiment of the invention. After a start block, the logical flow moves to block 1310 where the logic determines the current drawing location for the OSD animation system. The current drawing location is monitored to determine when the drawing address for the OSD is within the programmable area used to display the animation sequence. According to one embodiment, the animation sequence is drawn within the programmable area in the OSD frame.

Transitioning to decision block 1320, a determination is made as to whether the current drawing location is the location to draw the animation sequence. When the drawing location is not the location to draw the animation sequence, the logic returns to block 1310. When the drawing location is the location to draw the animation sequence, the logic flows to block 1330 at which point the animation sequence may be displayed. The logical flow then ends.

Figure 14:
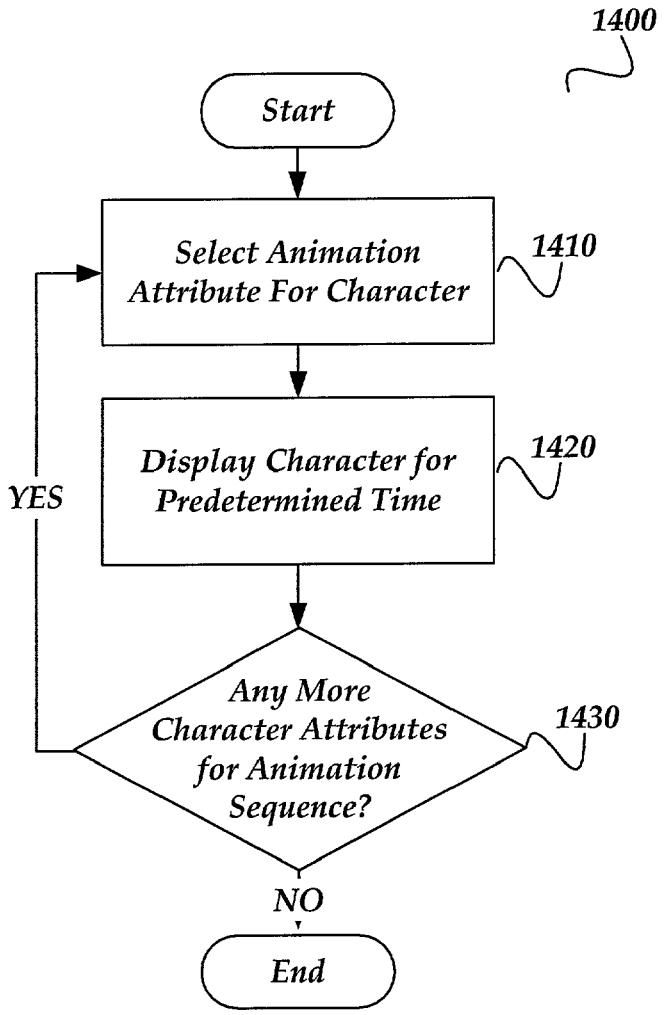
FIG. 14 illustrates a logical flow for performing an animation sequence, in accordance with aspects of the invention.

FIG. 14 illustrates a logical flow for performing an animation sequence, according to one embodiment of the invention. After a start block, the logic flows to a block 1410 at which point the color attributes for one frame of the animation sequence are selected. Transitioning to block 1420, the character is displayed using the selected attributes for a predetermined period. The predetermined time is based on the desired frame rate for the animation sequence. Moving to decision block 1430, a determination is made as to whether there are any more color attributes to display another frame of the animation sequence. When there are more color attributes the logic returns to block 1410, at which point the next color attribute is chosen. When there are no more character attributes for the animation sequence, the logical flow moves to an end block and terminates.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus for displaying an animation sequence within a programmable area of an on screen display (OSD), comprising:

an attribute table configured to store at least two attributes but no more than four color attributes for each of a predetermined number of characters used in the animation sequence on an OSD; and wherein the attribute table comprises a first icon attribute bank, a second icon attribute bank and a third icon attribute bank; wherein the first, second and third icon attribute banks are used to store attributes to create the animation sequence when alternately selected and applied to a single character;

a selector circuit including an address input coupled to an address signal, an FR input coupled to a frame character attribute, a first address input coupled to a first icon attribute stored within the attribute table, a second address input coupled to a second icon attribute stored within the attribute table, and a third address input coupled to a third icon attribute stored within the attribute table, wherein the selector circuit is arranged to alternately select one of the address inputs from the first, second, and third address inputs in response to a drawing location that is associated with at least one of the predetermined number of characters in order to create the animation sequence, and provide an attribute signal corresponding to the selected attribute to be applied to the character at the drawing location; and a color selection logic circuit that includes a first input coupled to the attribute signal, a first plane input that is configured to receive a first pixel stream; and a second plane input that is configured to receive a second pixel stream; wherein the color selection logic circuit is configured to expand the first pixel stream and the second pixel stream to colors based on the selected attribute and to apply the selected attribute to the character at the drawing location and produce a color signal in response to the attribute signal, wherein the character at the drawing location remains static but the attribute for the character alternately changes in order to create the animation sequence.

2. The apparatus of claim 1, further comprising a timing logic circuit configured to provide a count signal for a predetermined time, and wherein the selector circuit further being arranged to select the attribute in response to the drawing location and the count signal.

3. The apparatus of claim 2, wherein the selector circuit further being arranged to select the attribute for the predetermined time and further configured to select another attribute from the attribute table for the predetermined time.

4. The apparatus of claim 2, further comprising an icon select circuit that is configured to produce an icon enable signal in response to the drawing location, and wherein the selector circuit further being configured to select the attribute in response to the drawing location, the count signal, and the icon enable signal.

5. The apparatus of claim 4, wherein the icon enable signal is produced when drawing location corresponds to the programmable area of the OSD frame.

6. The apparatus of claim 5, wherein the attribute table configured to store the attributes that are used to provide coloring information for the pixels on the OSD, further comprises:

a frame attribute table configured to store frame character attributes; and an icon attribute table configured to store icon attributes.

7. The apparatus of claim 6, wherein the selector circuit is further configured to select an icon attribute from the icon attribute table in response to the icon enable signal and select a frame attribute from the frame attribute table when the icon enable signal corresponds to the current drawing location being outside the programmable area and within the OSD frame.

8. The apparatus of claim 7, wherein the selector circuit is further arranged to alternate for a predetermined time between at least two icon attributes stored within the icon attribute table.

9. The apparatus of claim 7, wherein the selector circuit is further arranged to select one icon attribute from the icon attribute table for the predetermined time and select a second icon attribute from the icon attribute table for the predetermined time.

10. The apparatus of claim 9, wherein the color selection logic circuit is further configured to output a red signal level, a blue signal level and a green signal level in response to the attribute signal.

11. A method for displaying an animation sequence within a programmable area of an on screen display (OSD), comprising:

determining a drawing location;

drawing frame characters to make up a frame for the OSD within an OSD frame area, wherein the fame is preprogrammed and static;

alternately selecting an attribute for a character from an attribute table that includes a plurality of attributes for each of up to six characters used to create the animation sequence that corresponds to coloring information for pixels within the character on an OSD based on the determined drawing location; wherein the attribute table comprises a first icon attribute bank, a second icon attribute bank and a third icon attribute bank; wherein the first, second and third icon attribute banks are used to store the plurality of attributes for up to the six characters to create the animation sequence when the first second, and third icon attribute banks are alternately selected and applied to one of the six characters;

expanding a first pixel stream and a second pixel stream to colors based on the selected attribute; and applying the selected attribute to the character, wherein the animation sequence is created by applying the attribute to the character while the character remains static; and producing a color signal based on the selected and applied attribute.

12. The method of claim 11, wherein selecting the attribute, further comprises selecting the attribute for a predetermined time.

13. The method of claim 12, further comprising selecting another attribute for the predetermined time.

14. The method of claim 12, wherein determining the drawing location further comprises determining when the drawing location is within the programmable area.

15. The method of claim 14, further comprising determining when the drawing location is within the OSD frame area and outside the programmable area.

16. The method of claim 15, wherein selecting the attribute further comprises:

selecting the attribute from a frame attribute table when the drawing location is within an OSD frame area and outside the programmable area; and selecting the attribute from an icon attribute table when the drawing location is within the programmable area.

17. The method of claim 16, wherein selecting the attribute from the icon attribute table further comprises alternating selection of the attribute between a first icon attribute and a second icon attribute.

18. The method of claim 17, wherein alternating the selection of the attribute between the first icon attribute and the second icon attribute occurs for a predetermined time.

19. The method of claim 18, wherein the color signal produced further comprises a red component, a green component, and a blue component.

20. An apparatus for displaying an animation sequence within a programmable area of an on screen display (OSD), comprising:

a means for determining a drawing location;

a selector circuit including an address input coupled to an address signal, an FR input coupled to a frame character attribute, a first address input coupled to a first icon attribute stored within an attribute table, a second address input coupled to a second icon attribute stored within the attribute table, and a third address input coupled to a third icon attribute stored within the attribute table, wherein the selector circuit includes a means for alternating selection between the first, second, and third address inputs for a predetermined time based on the current drawing location for a character that remains static during the animation sequence; wherein the attribute table stores at most four color attributes for each of a predetermined number of characters; and wherein the attribute table comprises a first icon attribute bank, a second icon attribute bank and a third icon attribute bank; wherein the first, second and third icon attribute banks are used to store the at most four color tributes for each of the predetermined number of characters to create the animation sequence when alternately selected and applied to one of the predetermined number of characters; and a means for expanding at least two pixel streams to colors based on the selected attribute;

a means for producing a color signal based on the selected attribute.

* * * * *

UNITED STATES PATENT AND TRADEMARK OFFICE

CERTIFICATE OF CORRECTION

PATENT NO. : 7,176,929 B1
APPLICATION NO. : 09/908119
DATED : February 13, 2007
INVENTOR(S) : Morrish It is certified that error appears in the above-identified patent and that said Letters Patent is hereby corrected as shown below:

Claim 11, Line 6, change “fame” to --frame--.

Signed and Sealed this

Sixteenth Day of October, 2007

JON W. DUDAS
*Director of the United States Patent and Trademark Office*